US006805660B1

(12) United States Patent
Finch

(10) Patent No.: US 6,805,660 B1
(45) Date of Patent: Oct. 19, 2004

(54) PROCESS FOR MANUFACTURING A FLAT-BOTTOM BAG AND BAG FORMED THEREBY

(76) Inventor: Doug Finch, 9578 North Chippewa Road, Caistor Centre, Ontario (CA), L0R 1E0

( * ) Notice: Subject to any disclaimer, the term of this patent is extended or adjusted under 35 U.S.C. 154(b) by 0 days.

(21) Appl. No.: 10/407,471

(22) Filed: Apr. 7, 2003

(51) Int. Cl.[7] ..... B31B 1/90

(52) U.S. Cl. ..... 493/218; 493/219; 493/220; 493/331; 493/328; 493/936

(58) Field of Search ..... 493/218, 219, 493/220, 264, 267, 331, 328, 326, 936, 922, 217, 255, 333, 907, 210; 383/125, 126

(56) References Cited

U.S. PATENT DOCUMENTS 333,523 A * 1/1886 Honiss ..... 383/121
692,695 A * 2/1902 Mullen ..... 493/241
3,690,221 A 9/1972 Schmedding
4,976,674 A * 12/1990 Yannuzzi et al. ..... 493/195
5,102,383 A * 4/1992 Achelpohl et al. ..... 493/226
5,314,252 A * 5/1994 Happ ..... 383/126
5,549,538 A 8/1996 Marsik
5,795,283 A * 8/1998 Romer ..... 493/243
5,913,764 A 6/1999 Kolbe et al.

* cited by examiner

*Primary Examiner*—Rinaldi Rada
*Assistant Examiner*—Sameh H. Tawfik
(74) *Attorney, Agent, or Firm*—Patrick J. Hofbauer

(57) ABSTRACT

A process for manufacturing a flat-bottom bag is disclosed. The process comprises the steps of providing a bag preform and a patch, the patch having a first adhesive coating thereon. The preform is positioned at an open configuration thereof, whereat its flaps extend substantially away from one another. Thereafter, the patch is positioned a sealing position against the preform, with the first adhesive coating therebetween, to form a preform/patch composite. Thence, a second adhesive coating is applied on the preform/patch composite, and the flaps are folded, in sequence, onto the gusset panels, to respective closure positions, where they are secured by the second adhesive coating.

18 Claims, 9 Drawing Sheets

PROCESS FOR MANUFACTURING A FLAT-BOTTOM BAG AND BAG FORMED THEREBY

FIELD OF THE INVENTION

The present invention relates to the field of flat-bottom bags, and more particularly, to processes for manufacturing the same.

BACKGROUND OF THE INVENTION

Flat-bottom bags are well-known in the prior art. Such flat-bottom bags are commonly constructed of tubes of paper, closed at one end in accordance with any of a multiplicity of known processes.

The steps of one such known process are illustrated in FIGS. 1–2B of U.S. Pat. No. 5,314,252 (Happ), issued May 24, 1994. In this process, opposite sides of a tube end are folded in to leave flap portions (this configuration is typically referred to as a full diamond fold configuration), and a layer of adhesive material is applied, as shown in FIG. 1. Thereafter, rotary folding clamps, also known as front and back jaws (not shown), fold the flap portions, in sequence, against the folded-in portions, whereupon they are adhered in place by the adhesive. This forms a bag, as shown in FIGS. 2, 2B, that is quite suitable for use, for example, as a grocery bag. However, such bag, when used for the containment of particulate material, such as flour or sugar, has been found to be susceptible to leakage.

Accordingly, attempts have been made in the prior art to avoid such leakage.

Several such attempts, in the nature of variants of the foregoing process, are described in the Happ reference.

As one variant, illustrated in FIG. 3 of the Happ reference, a patch is adhesively attached to the bag bottom. This reduces migration of particulate materials, thereby rendering the bag relatively more suitable for use therewith. However, leakage can persist at problematic levels. Further, the external patch is susceptible to partial detachment, which detracts from aesthetics of the bag.

As another variant, illustrated in FIG. 4 of the Happ reference, the bag is formed of two ply material, and provided with a staggered slit, such that the outer ply forms an integrated patch. This improves aesthetics. However, leakage can still persist at problematic levels.

Another known process is described in U.S. Pat. No. 5,913,764 (Kolbe et al.), issued Jun. 22, 1999. In this process, a patch is provided interiorly of a bag of the full diamond configuration. This process is taught to lessen leakage, and provides aesthetics identical to other full diamond bags. However, it suffers from the need to employ contact adhesives, thereby rendering it unsuitable for adaptation to many existing bag-forming lines.

It is also known to practise the Kolbe et al. process in conjunction with bags of the staggered slit variety. This process is similarly known to lessen leakage, and to provide aesthetics identical to other staggered slit bags. However, it continues to suffer from the need to employ contact adhesives.

It is an object of the invention to provide a process for manufacturing a relatively leak-proof flat-bottom bag which does not suffer from the need to employ contact adhesives.

This object, amongst others, is met by the present invention, a process for manufacturing a flat-bottom bag.

SUMMARY OF THE INVENTION

According to one aspect, the process comprises the step of providing a bag preform and a patch.

The patch has a first adhesive coating thereon.

The preform is formed from an elongate tube of bag-forming material, said tube comprising an inner tubular liner of bag-lining material sheathed by an outer tubular shell of bag-facing material and having a peripheral baseline which divides said tube into a tubular wall-forming part including a preform upper end and a tubular bottom-forming part including a preform lower end.

The bottom-forming part has four division lines, running lengthwise, along the length of the tube, which divide said bottom-forming part into four substantially rectangular bottom-forming portions including a pair of substantially congruent flap-forming panels and a pair of substantially congruent gusset panels, disposed in alternating relation.

One of the flap of forming panels has a staggered slit arrangement including a pair of relatively long first slits and a pair of relatively short second slits. The first slits are formed through the shell, extend from the preform lower end, lengthwise, to respective termini and are arranged such that each of the division lines which bracket said flap forming panel has a respective one of the first slits disposed relatively proximal thereto. The second slits are formed through the liner, extend from the preform lower end, lengthwise, to respective termini and are arranged such that each of the division lines which bracket said flap forming panel has a respective one of the second slits disposed relatively distal thereto.

Each flap-forming panel has a pair of flap-forming creases associated one each with the division lines which bracket said each flap-forming panel and each extending in angular relation to its associated division line and from the intersection thereof with the peripheral baseline to, with respect to the other one of the flap-forming panels, the preform lower end, so as to divide said flap-forming panel into a quadrilateral flap and a pair of opposed triangular gussets; and with respect to said one of said flap-forming panels, the terminus of a respective first slit, in the case of the shell, and the terminus of a respective second slit, in the case of the liner, so as to divide said flap-forming panel into a ridged flap and a pair of opposed polygonal gussets.

The preform is provided in an open configuration. At the open configuration, the triangular gussets and the polygonal gussets are folded inwardly along the flap-forming creases contiguous therewith such that the division lines are arranged substantially coincident with the peripheral baseline, thereby to form, with the quadrilateral flap and the ridged flap, respectively, primary and secondary flaps. Further, the primary and secondary flaps extend substantially away from one another, such that the triangular gussets and the polygonal gussets form substantially smooth continuous surfaces with the gusset panels to which they are respectively attached.

The method also comprises the step of positioning the patch at a sealing position against said smooth continuous surfaces, with the first adhesive coating disposed therebetween, to form a preform/patch composite.

The method also comprises the steps of: folding the primary flap about the peripheral baseline to a closure position thereof whereat same lies in substantially stacked relation relative to the gusset panels; folding the secondary flap about the peripheral baseline to a closure position thereof whereat same lies in substantially stacked relation against the primary flap; and providing means for securing the primary flap and the secondary flap at their respective closure positions.

As another aspect, the invention also comprises a bag formed in accordance with the foregoing process.

Other advantages, features and characteristics of the present invention will become apparent upon consideration of the following detailed description and the appended claims with reference to the accompanying drawings, the latter of which is briefly described hereinafter.

BRIEF DESCRIPTION OF THE DRAWINGS

In the accompanying drawings, which are for the purpose of illustration and description only, and are not intended as a definition of the limits of the invention.

DETAILED DESCRIPTION OF A PREFERRED EMBODIMENT

Referring now with general reference to FIGS. 1–14, a method according to a preferred embodiment of one aspect of the present invention is hereinafter described.

Figure 3:
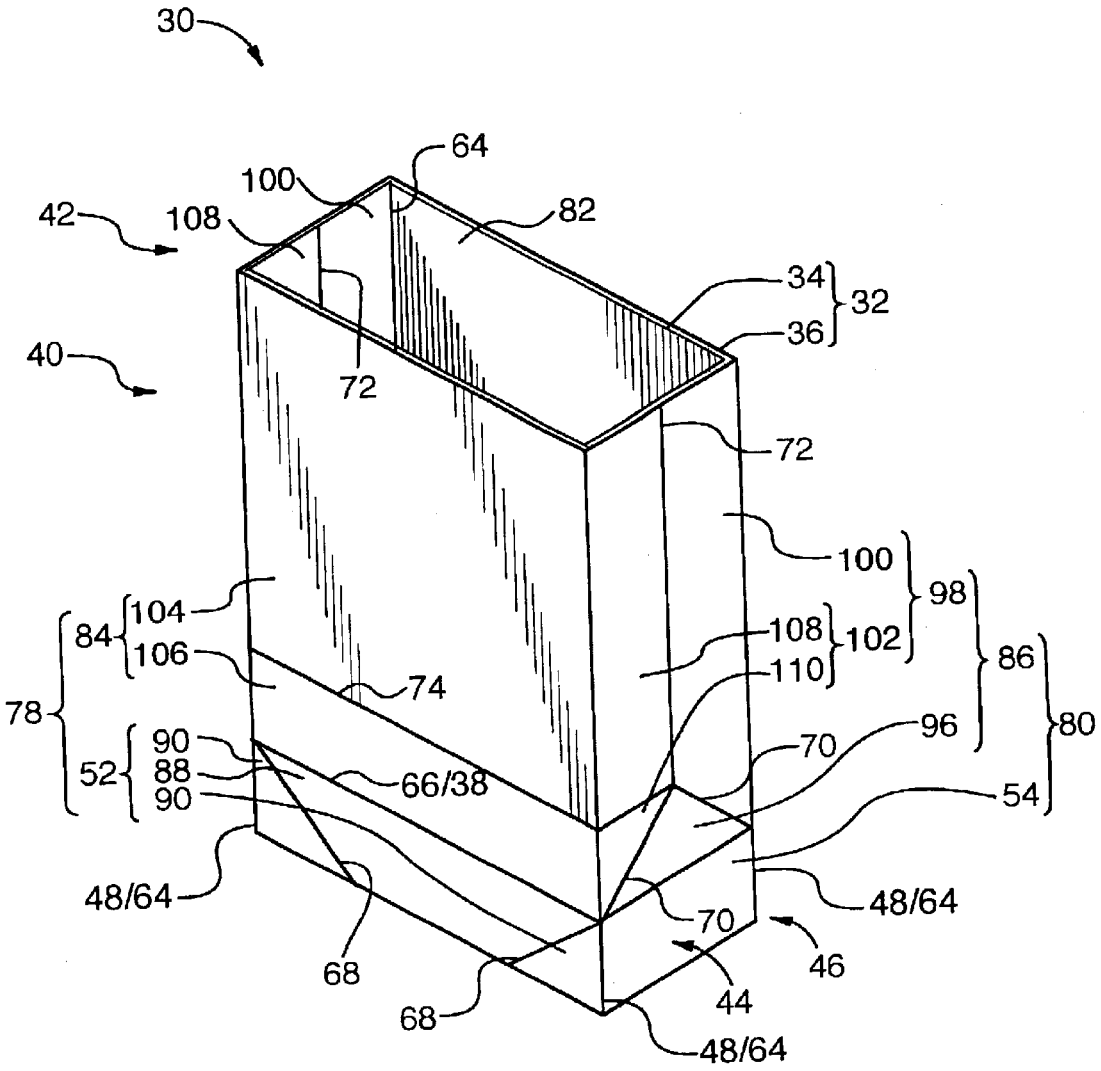
FIG. 3 is a perspective view of the structure of FIG. 1, shown in an unfolded configuration thereof.

As an initial step in such method, a bag preform is provided, a preferred embodiment of said preform being illustrated in FIG. 3 and designated with general reference numeral 30.

The preferred preform 30 is of conventional staggered slit construction, as previously discussed, but for ease of reference in the following process description, will hereinafter be described in detail.

Firstly, the preform 30 of the preferred embodiment should be understood to be formed from an elongate tube 32 of bag-forming material.

Figure 4:
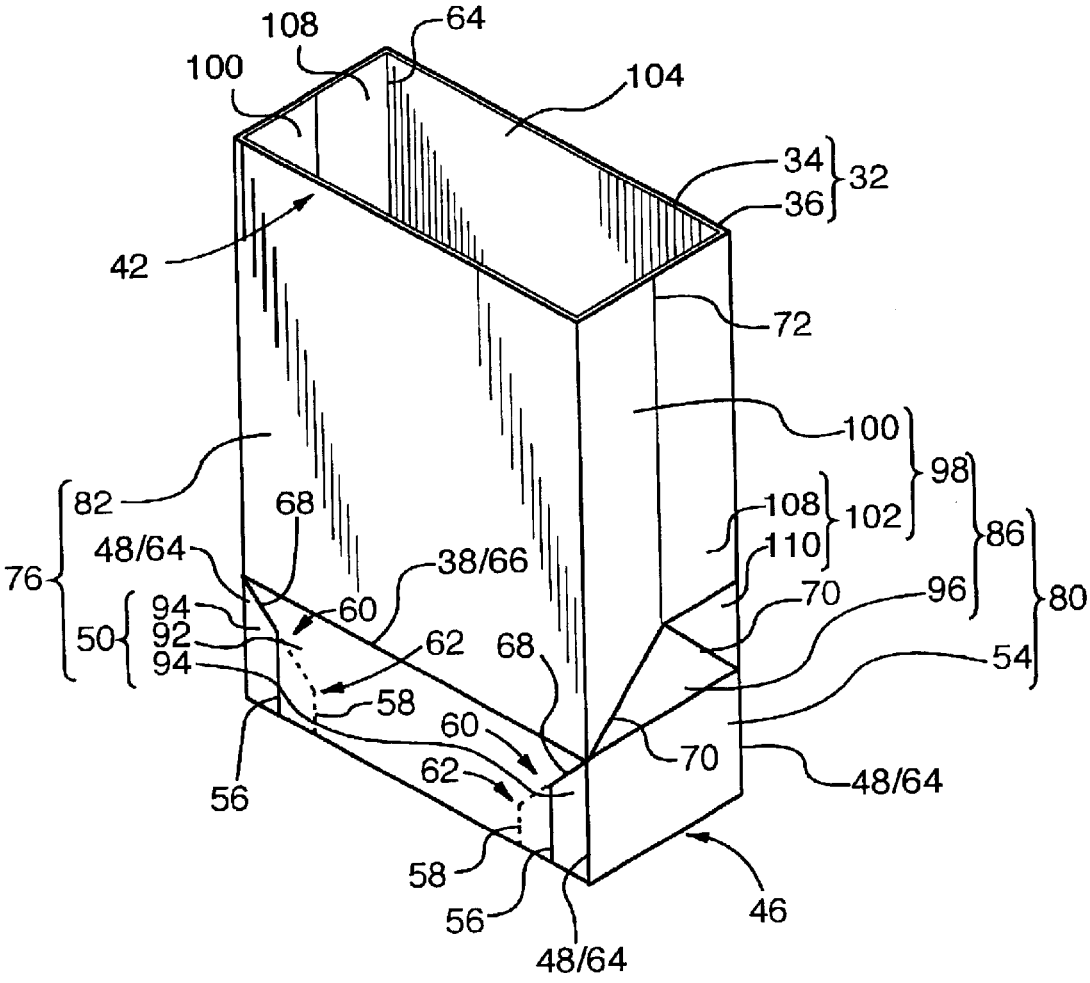
FIG. 4 is a perspective view of the structure of FIG. 1, from a vantage opposite to that of said FIG. 3.

Such tube is best seen in FIGS. 3,4, wherein the preform 30 is shown in an unfolded configuration for clarity. It should be emphasized at this time that the preform 30 need not, and in most cases will not, at any time in the process, appear in the unfolded configuration as shown in FIGS. 3,4; the illustrations are provided only to simplify the description of the various structural features of the preferred preform 30.

Continuing now with the description, with general reference to FIGS. 3,4, preform 30 comprises an inner tubular liner 34 of bag-lining material, such as manila paper, sheathed by an outer tubular shell 38 of bag-facing material, such as glossy paper, and has a peripheral baseline 38 which divides said tube 32 into a tubular wall-forming part 40 including a preform upper end 42 and a tubular bottom-forming part 44 including a preform lower end 46.

The bottom-forming part 44 has four division lines 48, running lengthwise, along the length of the tube 32, and dividing said bottom-forming part 44 into four substantially rectangular bottom-forming portions 50,52,54,54 including a pair of substantially congruent flap-forming panels 50,52 and a pair of substantially congruent gusset panels 54,54, disposed in alternating relation.

As best indicated in FIG. 4, one of the flap-forming panels 50 has a staggered slit arrangement including a pair of relatively long first slits 56 and a pair of relatively short second slits 58, the latter being illustrated in phantom.

The first slits 56 are formed through the shell 36, extend from the preform lower end 46, lengthwise, to respective termini 60, and are located and arranged such that each of the division lines 48 which bracket said flap forming panel 50 has a respective one of the first slits 56 disposed relatively proximal thereto.

The second slits 58 are formed through the liner 34, extend from the preform lower end 46, lengthwise, to respective termini 62, and are arranged and located such that each of the division lines 48 which bracket said flap forming panel 50 has a respective one of the second slits 58 disposed relatively distal thereto.

The preform 30 further has a number of creases, namely, longitudinal creases 64, a peripheral crease 66, flap-forming creases 68, bag-opening creases 70, medial creases 72 and an intermediate crease 74.

With regard to the longitudinal creases 64, four are provided on the preform 30, associated one each with the division lines 48 and coincident therewith.

The longitudinal creases 64 divide the preform 30 into four substantially rectangular preform portions 76,78,80,80 associated one each with the bottom-forming portions 50,52, 54,54 and each including its associated bottom-forming portion, said preform portions 76,78,80,80 include a pair of substantially congruent face preform portions 76,78 associated one each with the flap-forming panels 50,52, and a pair of substantially congruent side preform portions 80,80 associated one each with the gusset panels 54,54.

The peripheral crease 66, which is aligned coincident with the peripheral baseline 38, serves to divide said face preform portions 76,78 into said flap-forming panels 50,52 and into respective face wall panels 82,84, and to divide said side preform portions 80,80 into said gusset panels 54,54 and into respective side wall panels 86,86.

The aforementioned flap-forming creases 68 are provided in pairs, each flap-forming panel 50,52 having one such pair, the pair being associated one each with the division lines 48 which bracket said each flap-forming panel 50,52 and each extending in angular relation to its associated division line 48 and from the intersection thereof with the peripheral baseline 38 to, with respect to the other one 52 of the flap-forming panels, the preform lower end 46, so as to divide said flap-forming panel 52 into a quadrilateral flap 88 and a pair of opposed triangular gussets 90, and with respect to said one 50 of said flap-forming panels, the terminus 60 of a respective first slit 56, in the case of the shell 36, and the terminus 62 of a respective second slit, in the case of the liner 34, so as to divide said flap-forming panel 50 into a ridged flap 92 and a pair of opposed polygonal gussets 94.

The bag-opening creases 70 are similarly provided in pairs, one for each side wall panel 86, said bag-opening creases 70 being associated one each with the longitudinal creases 64 which bracket said each side wall panel 86 and extending, each from the intersection of its associated longitudinal crease 64 with the peripheral crease 66, upwardly towards one another, so as to divide said each side wall panel 86 into a triangular base portion 96, contiguous with the gusset panel 54 of the side preform portion 80 of which said each side wall panel 86 forms part, and a notched portion 98.

The medial creases 72 are provided one for each side wall panel 86 and extend lengthwise from the intersection of the bag-opening creases 70 thereof to the preform upper end 42 to divide the notched portion 98 of said each side wall panel 86 into a pair of polygonal panels 100,102.

Finally, the intermediate crease 74 extends, in parallel relation to the peripheral crease 66, between the intersections of the bag-opening creases 70 of each side wall panel 86 to divide one 84 of the face wall panels into a primary part 104 spaced from the flap-forming panel 52 of the face preform portion 78 of which said face wall panel 104 forms part, and a secondary part 106 contiguous with said flap-forming panel 52, and to divide each of the polygonal panels 102 contiguous with said one 52 flap-forming panel into an upper primary part 108 and a lower secondary part 110.

Figure 5:
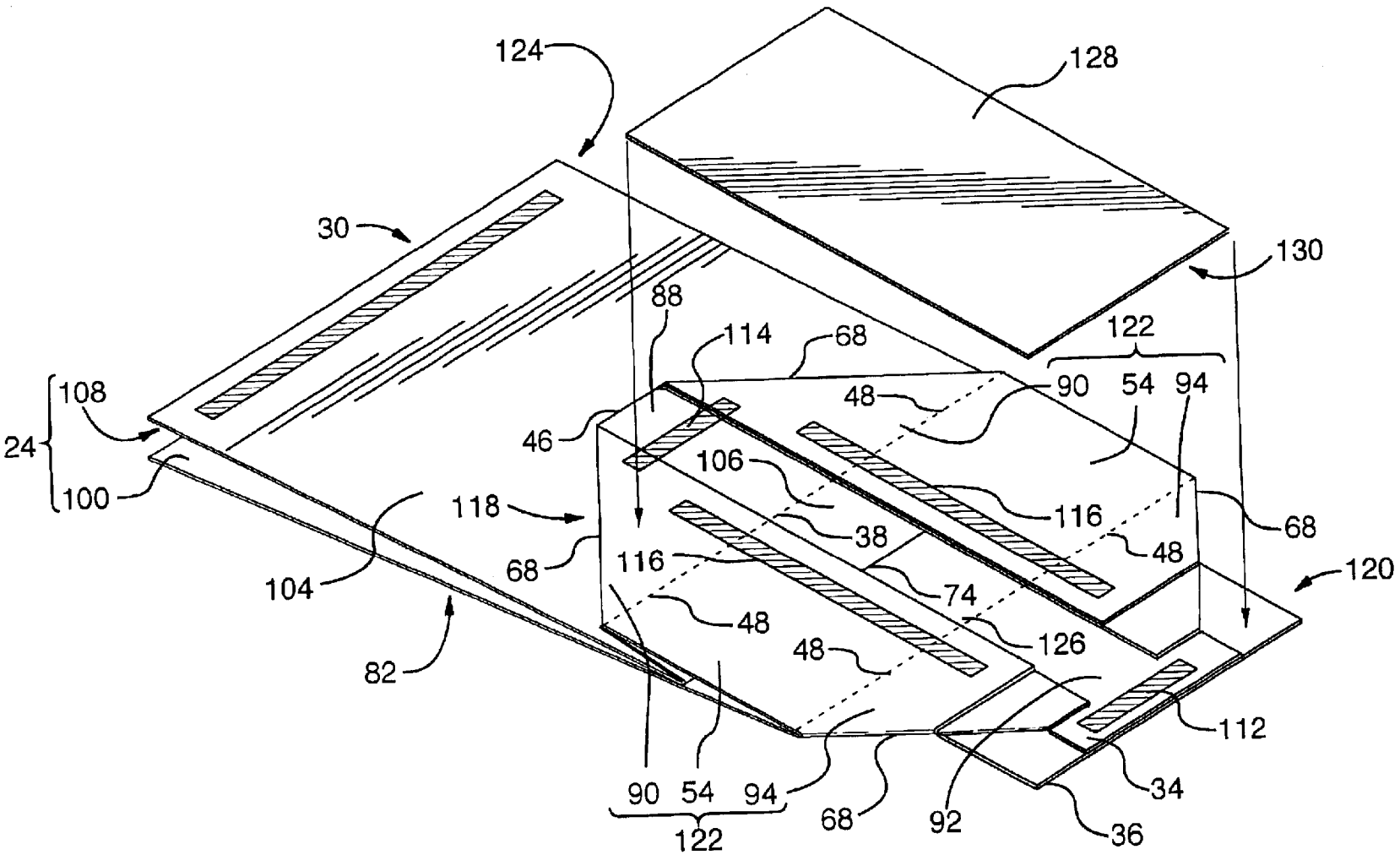
FIG. 5 is a view similar to FIG. 2, additionally showing a patch in an elevated position.

The preform 30 further has a number of adhesive layers, as indicated in FIG. 5, namely, a first adhesive layer 112, a second adhesive layer 114 and a pair of third adhesive layers 116, each disposed between the liner 34 and the shell 36.

The first adhesive layer 112 extends about the preform lower end 46 substantially continuously between the second slits 58 of said one 50 flap-forming portion.

The second adhesive layer 114 extends about the preform lower end 46 substantially continuously between the flap-forming creases 68 of the other 52 flap-forming portion.

The third adhesive layers 116 extend about the preform lower end 46, associated one each with the gusset panels 54 and extending substantially continuously thereacross and beyond the division lines 48 bracketing same.

The manner in which the adhesive layers 112,114,116, the creases 64, 66, 68, 70, 72 and 74 and the staggered slit arrangement are incorporated into the tube 32 is well-known to persons of ordinary skill in the art, and as such, is not described herein in detail.

Figure 2:
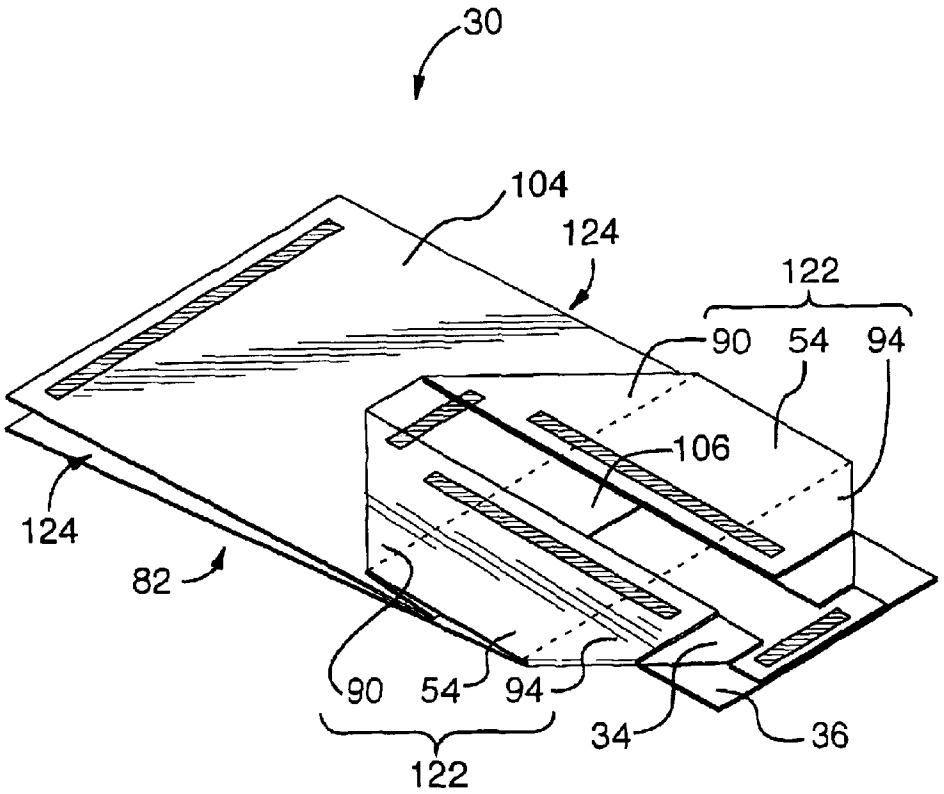
FIG.2 (PRIOR ART)
FIG. 2 is a perspective view of the structure of FIG. 1.
Figure 1:
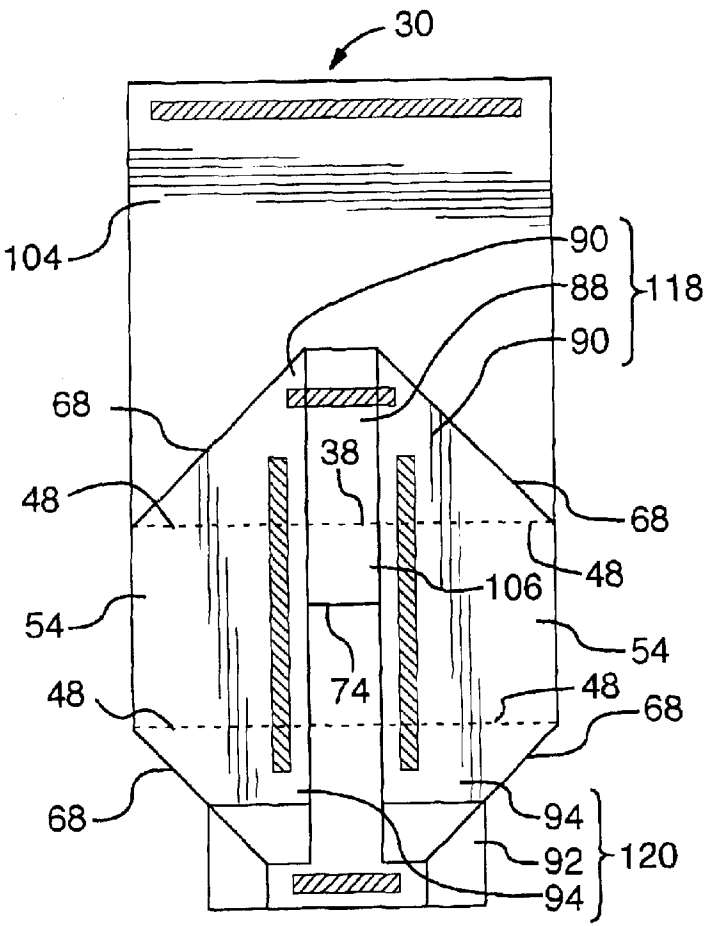
FIG.1 (PRIOR ART)
FIG. 1 is a top plan view of a prior art bag preform.

Although the foregoing description has made frequent reference to FIG. 3 and FIG. 4, wherein the preform 30 is shown in an unfolded configuration as aforediscussed, it is again noted that, for the preferred embodiment of the inventive process herein described, the preform 30 is provided in an open configuration, as shown in FIGS. 1,2 whereat various components of the preform 30 assume specific spacial and geometric relationships to one another.

As one such relationship present when the preform 30 is at the open configuration thereof, the triangular gussets 90 and the polygonal gussets 94 are folded inwardly along the flap-forming creases 68 contiguous therewith such that the division lines 48 are arranged substantially coincident with the peripheral baseline 38, thereby to form, with the quadrilateral flap 88 and ridged flap 92, respectively, primary 118 and secondary 120 flaps.

As another such relationship, at the open configuration, the primary 118 and secondary 120 flaps extend substantially away from one another, such that the triangular gussets 90 and the polygonal gussets 94 form a pair of substantially smooth continuous surfaces 122,122 with the gusset panels 54 to which they are respectively attached, as indicated in FIG. 5.

Yet further, at the open configuration, each side wall panel 86 is folded along the medial crease 72 thereof such that the primary part 108 of each of the polygonal panels 102 contiguous with said one 84 face wall panel is stacked against the adjacent polygonal panel 100, with the bag-facing material thereof in contact, to form a pleat 124.

Additionally, as another relationship, at the open configuration, the primary part 104 of said one 84 face wall panel and the other 82 face wall panel are disposed in stacked relation to one another, with the pleats 124,124 interleaved therebetween.

As well, at the open configuration, said one 84 face wall panel is folded along the intermediate crease 74 such that the secondary part 106 thereof is disposed in stacked relation against the primary part 104 thereof, with the bag-facing material thereof in contact, thereby to leave exposed a portion 126 of the other 82 face wall panel which, in combination with quadrilateral flap 88, said secondary part 106 and the ridged flap 92, forms a substantially smooth surface.

Against the following background, the balance of the method of the preferred embodiment shall be hereinafter described, and should be understood to comprise, as another initial step, the provision of a patch 128, shown in, FIG. 5, having a first adhesive coating 130 thereon. The first adhesive coating 130 is on the underside of the patch 128 in FIG. 5, and thus, is not visible.

Figure 7:
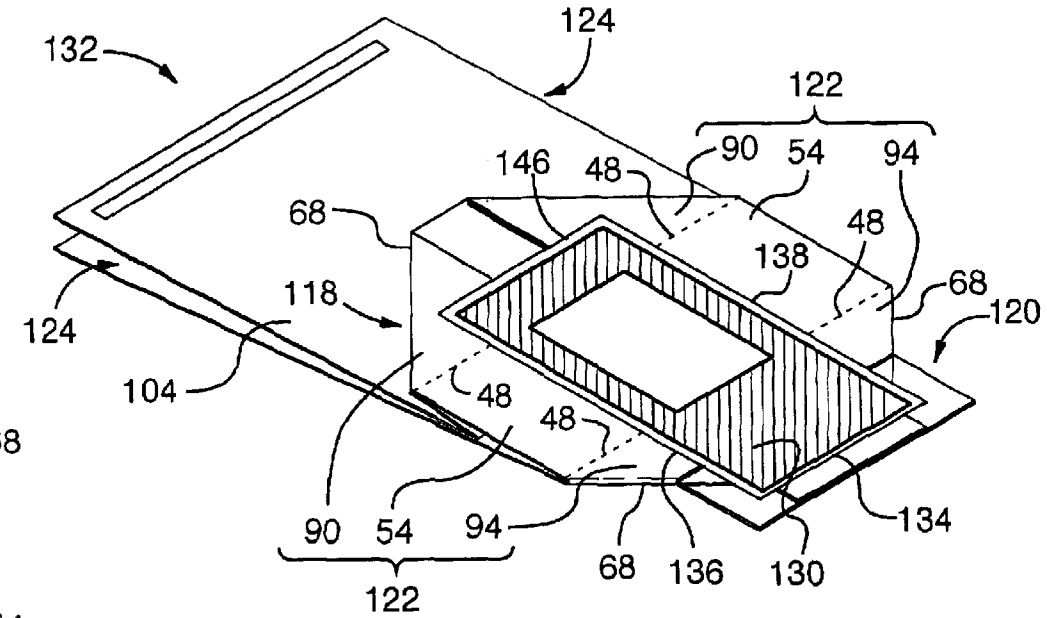
FIG. 7 is a perspective view of the structure of FIG. 6.
Figure 6:
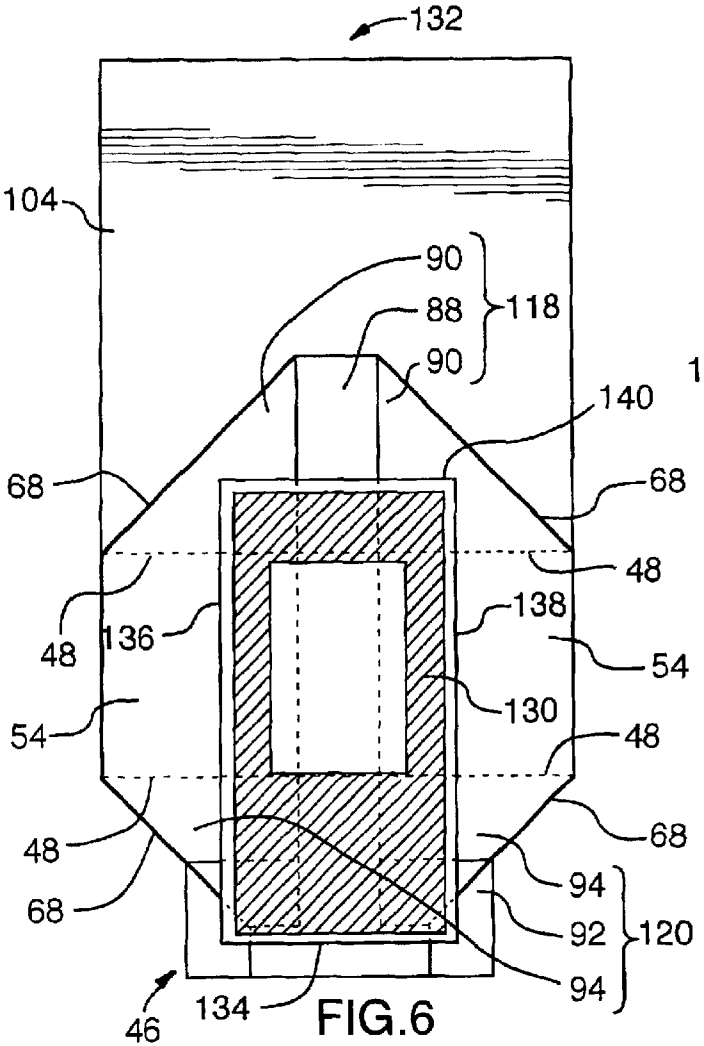
FIG. 6 is a top view of the structures of FIG. 5, with the patch disposed at a sealing position.

As a subsequent step, the patch 128 is positioned at a sealing position against the smooth continuous surfaces 122,122 formed by the triangular gussets 90 and the polygonal gussets 94 with the gusset panels 54 to which they are respectively attached, with the first adhesive coating 130 disposed therebetween, to form a preform/patch composite 132, as indicated in FIGS. 6,7.

In the preform/patch composite 132, the peripheral edge 134,136,138,140 of the patch 128 includes an elongate first edge 134, elongate second 136 and third 138 edges, as well as a fourth edge 140.

The first edge 134 is aligned, on the ridged flap 92, substantially parallel to the preform lower end 46, is disposed between the preform lower end 46 and the polygonal gussets 94, and extends substantially between the first slits 56,56. The elongate second 136 and third 138 edges extend, from opposite ends of the first edge 134, onto and across polygonal gussets 94, across the gusset panels 54, and onto the triangular gussets 90, to respective ends. The fourth edge 140 extends between the ends of the second 136 and third 1138 edges.

The first adhesive coating 130 seals the peripheral region of the patch 128 to the primary 118 and secondary 120 flaps and to the gusset panels 54. Such sealing is effected by configuring the first adhesive coating 130 to extend in a rectangular manner around the underside of the patch 128, covering substantially all portions of the patch 128 which overlie the primary 118 and secondary 120 flaps in the preform/patch composite 132 and covering portions of the patch 128 which overlie the wall-forming part 40 immediately adjacent the peripheral baseline 38 in the preform/patch composite 132, as indicated by FIGS. 6,7, wherein the extent of the first adhesive coating 130 under the patch 128 is indicated by cross-hatching.

As can be seen from FIGS. 6, 7, the first adhesive coating 130 stops just short of the peripheral edge 134,136,138,140 of the patch 128, so as to minimize adhesive spillage onto associated bag-forming machinery (not shown), and also stops well short of the preform lower end 46 in the area of the gusset panels 54, so as to minimize the potential for the bag to be inadvertently glued shut.

Figure 9:
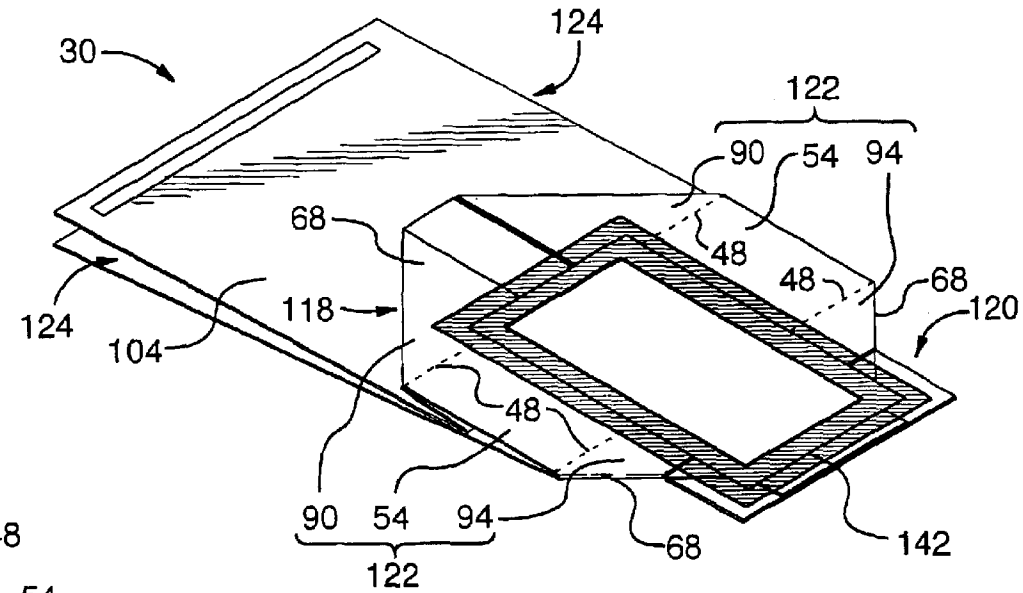
FIG. 9 is a perspective view of the structure of FIG. 8.
Figure 8:
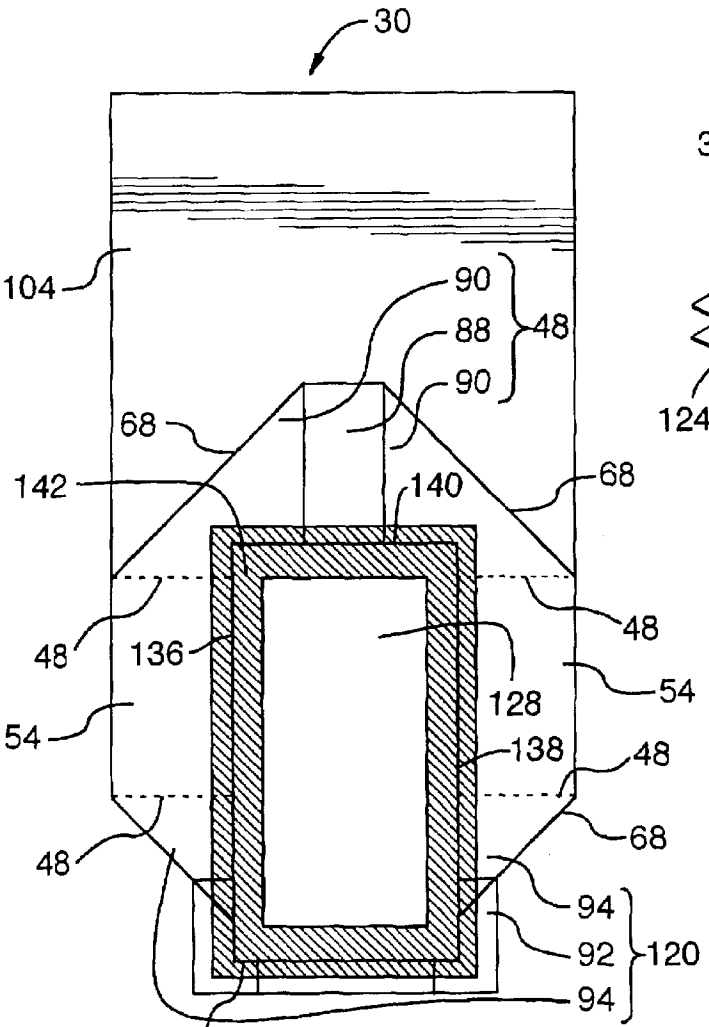
FIG. 8 is a view similar to FIG. 6, with a second adhesive coating applied thereto.
Figure 11:
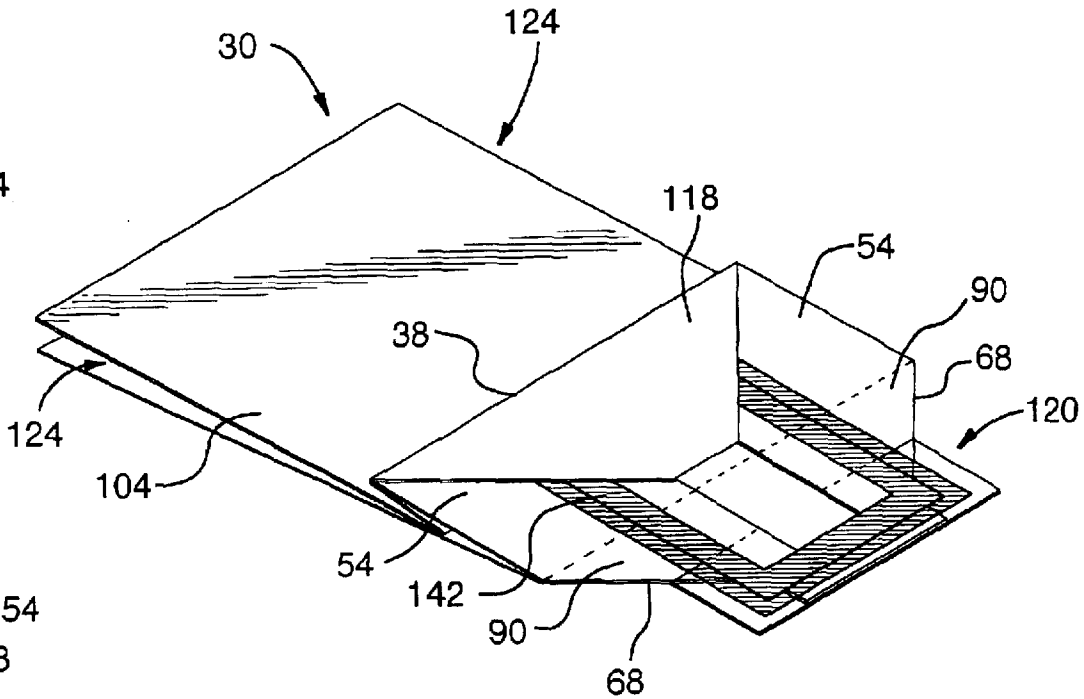
FIG. 11 is a perspective view of the structure of FIG. 10.
Figure 10:
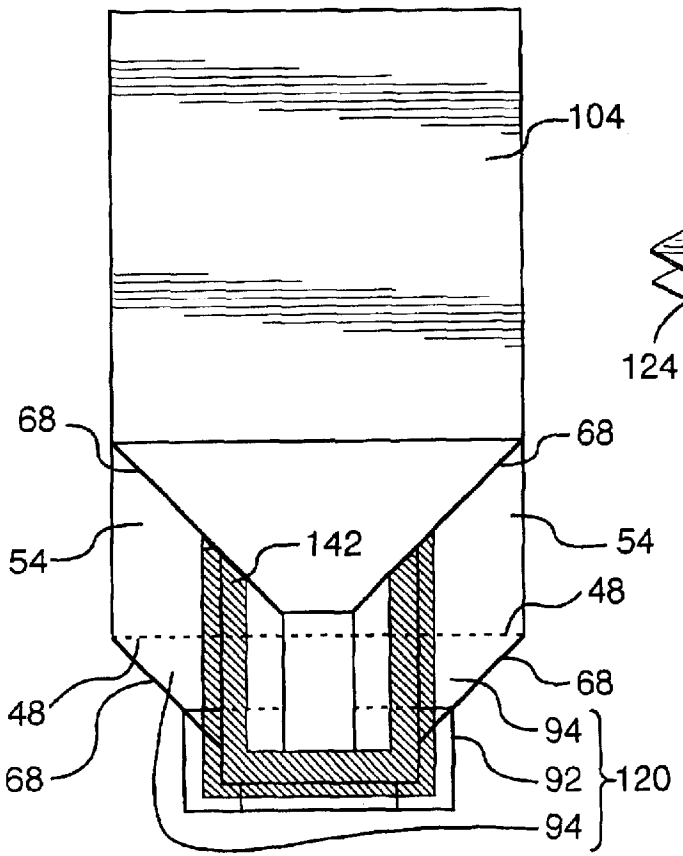
FIG. 10 is a view similar to FIG. 8, with a primary flap of said structure disposed at a closure position thereof.
Figure 12:
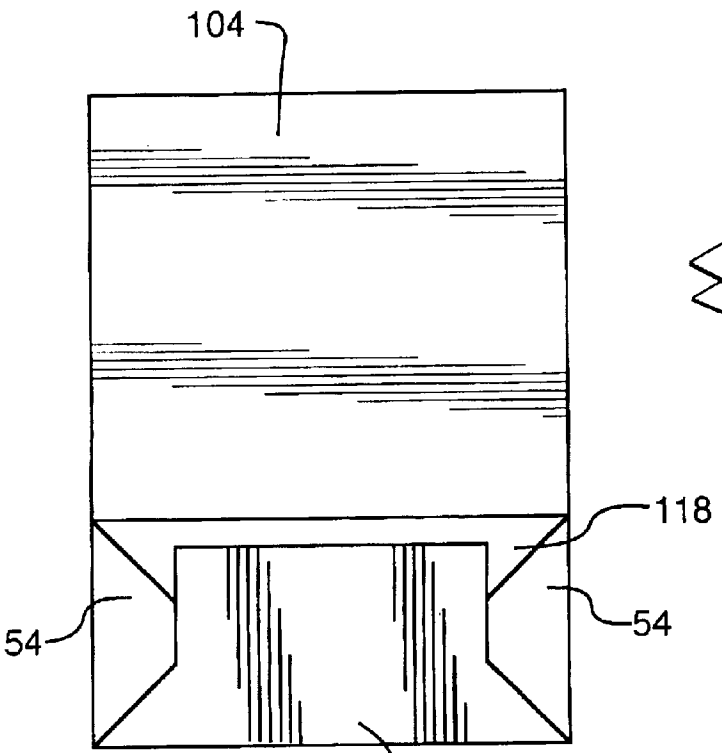
FIG. 12 is a view similar to FIG. 10, with a secondary flap of said structure disposed at a closure position thereof.

Thereafter, manufacture is completed by folding the primary flap 118 about the peripheral baseline 38 to a closure position thereof whereat same lies in substantially stacked relation relative to the gusset panels 54, as shown in FIGS. 10,11; folding the secondary flap 120 about the peripheral baseline 38 to a closure position thereof whereat same lies in substantially stacked relation against the primary flap 118, as shown in FIG. 12,13; and providing means 142 for securing the primary flap 118 and the secondary flap 120 at their respective closure positions. The preferred means 142 for securing the primary flap 118 and the secondary flap 120 at their respective closure positions takes the form of a second adhesive coating, applied on the preform/patch composite 132 prior to folding the primary flap 118 and the secondary flap 120 to their respective closure positions, as indicated in FIGS. 8,9, wherein the second adhesive coating 142 is shown in cross hatching. The aforementioned application, in the preferred embodiment, is done in a manner such that the second adhesive coating 142 coating extends around the patch peripheral edge 134,136,138,140, as illustrated in FIGS. 8,9, overlapping onto adjacent portions of the patch 128 and the preform 130.

Figure 13:
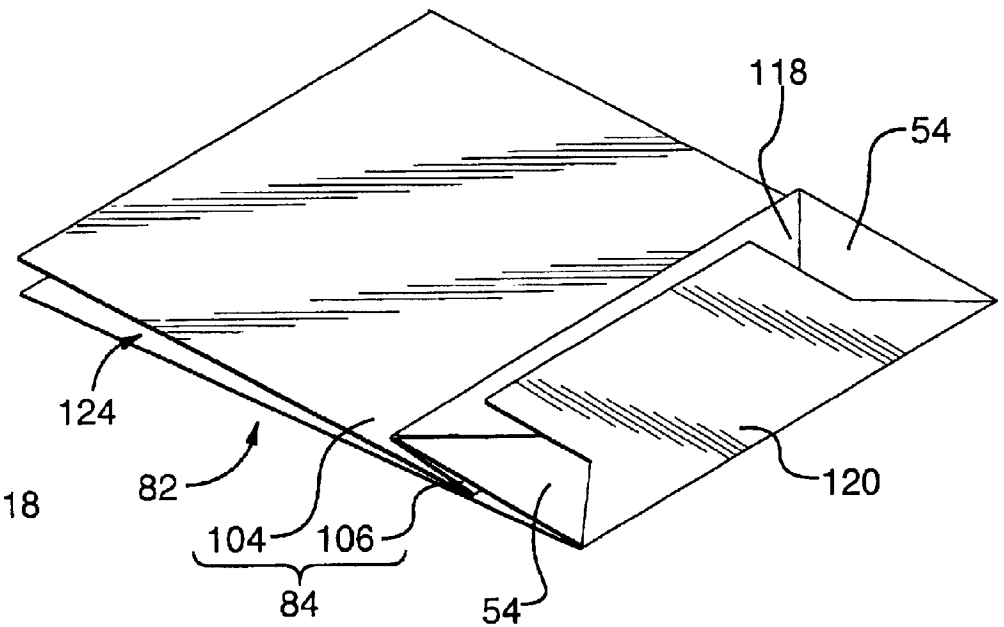
FIG. 13 is a perspective view of the structure of FIG. 12.
Figure 14:
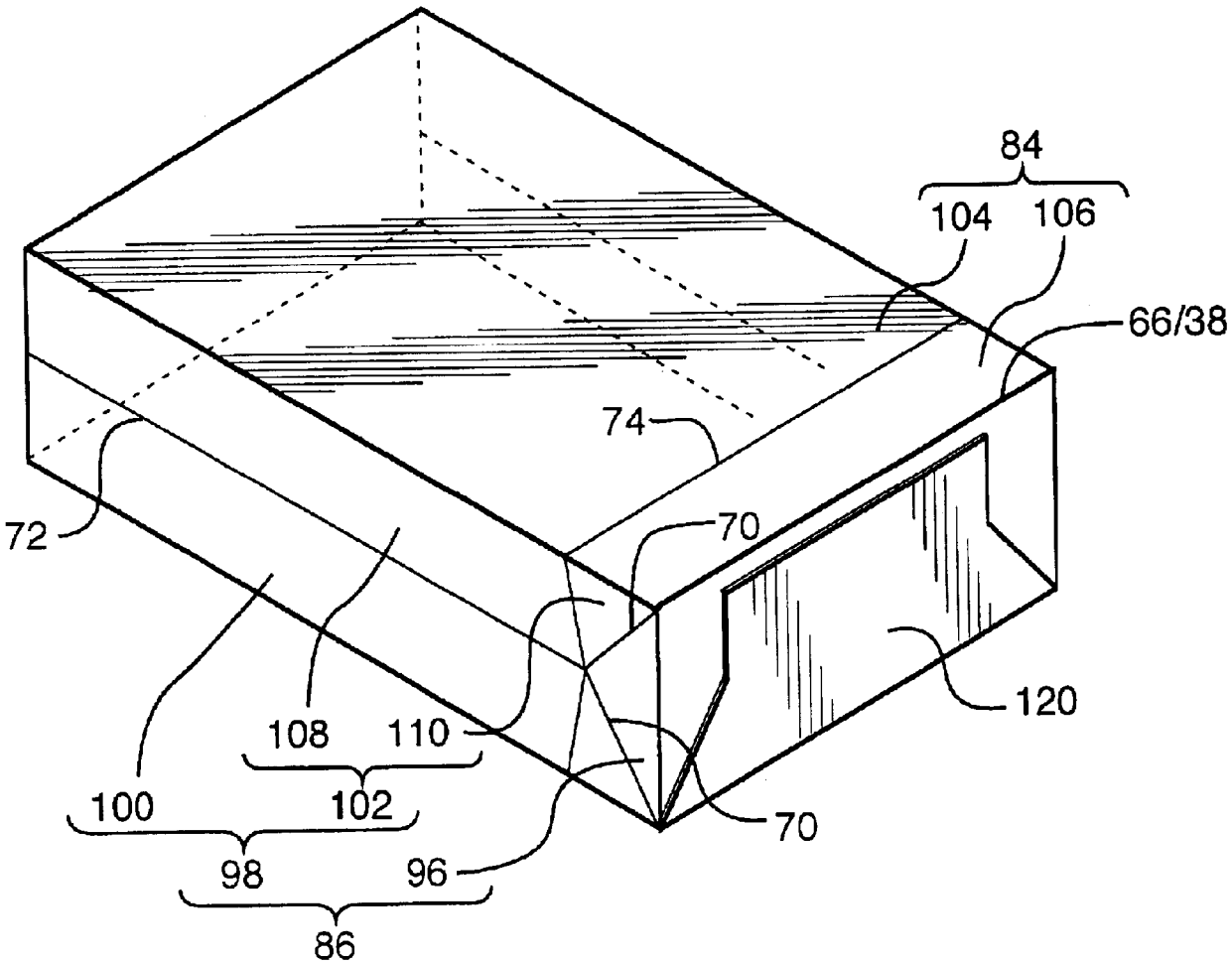
FIG. 14 is a perspective view of the structure of FIG. 13, arranged in an operative configuration.

This provides a flat-bottom bag, as shown in FIGS. 12,13, which may be positioned in an operative configuration, as shown in FIG. 14, to receive goods, such as popcorn, granulated sugar, flour or the like.

Without intending to be bound by theory, it is believed that the susceptibility of prior Happ-type bags to leakage derives largely from channels leading, along the lines about which the flaps are inwardly-folded, between the bag interior and exterior, resultant from imperfect adhesion between the flaps and the gusset panels. This imperfect adhesion, in turn, is believed to result from the folding clamps, which bear against said fold lines in the course of folding, and wipe away adhesive in the areas of contact. It is believed that the advantage of the present invention as compared to bags of the prior art, again, without intending to be bound by theory, does not derive from the absence of the aforementioned channels. Indeed, channels would still exist in the bag formed by the present invention, since the second adhesive coating remains susceptible to be wiped away in the region of contact with folding clamps. Rather, the advantage is believed to be obtained from the application of the patch before the preform is received by the folding clamps; this permits a substantially continuous seal of the peripheral region of the patch to the preform, thereby minimizing the ability of the bags contents to enter the channels.

While but a single preferred embodiment of the process of the present invention, and a single preferred embodiment of a bag according to the present invention have been herein described with particularity, it will be appreciated by persons of ordinary skill in the art that various modifications and alterations may be made without departing from the spirit and scope of the invention. Accordingly, it should be understood that the scope of the invention is to be limited only by the accompanying claims, purposively construed.

I claim:

1. A process for manufacturing a flat bottom bag, said process comprising the steps of:

I. providing a bag preform and a patch, said patch having a first adhesive coating thereon, said preform being formed from an elongate tube of bag-forming material, said tube comprising an inner tubular liner of bag-lining material sheathed by an outer tubular shell of bag-facing material and having a peripheral baseline which divides said tube into a tubular wall-forming part including a preform upper end and a tubular bottom forming part including a preform lower end, said bottom-forming part having four division lines, running lengthwise, along the length of the tube, and dividing said bottom-forming part into four substantially rectangular bottom-forming portions including a pair of substantially congruent flap-forming panels and a pair of substantially congruent gusset panels, disposed in alternating relation, wherein one of the flap-forming panels has a staggered slit arrangement including a pair of relatively long first slits formed through the shell, extending from the preform lower end, lengthwise, to respective termini and arranged such that each of the division lines which bracket said flap-forming panel has a respective one of the first slits disposed relatively proximal thereto; and a pair of relatively short second slits formed through the liner, extending from the preform lower end, lengthwise, to respective termini, and arranged such that each of the division lines which bracket said flap-forming panel has a respective one of the second slits disposed relatively distal thereto;

and wherein each flap-forming panel has a pair of flap-forming creases associated one each with the division lines which bracket said each flap-forming panel and each extending in angular relation to its associated division line and from the intersection thereof with the peripheral baseline to, with respect to the other one of the flap-forming panels, the preform or end, so as to divide said flap-forming panel into a quadrilateral flap and a pair of opposed triangular gussets; and with respect to said one of said flap-forming panels, the terminus of a respective first slit, in the case of the shell, and the terminus of a respective second slit, in the case of the liner, so as to divid said flap-forming panel into a ridged flap and a pair of opposed polygonal gussets, said preform being provided in an open configuration whereat the triangular gussets and the polygonal gussets are folded inwardly along the flap-forming creases contiguous therewith such that the division lines are arranged substantially coincident with the peripheral baseline, thereby to form, with the quadrilateral flap and the ridged flap, respectively, primary and secondary flaps and whereat the primary and secondary flaps extend substantially away from one another, such that the triangular gussets and the polygonal gussets form substantially smooth continuous surfaces with the gusset panels to which they are respectively attached;

ii. positioning the patch at a sealing position against said smooth continuous surfaces, with the first adhesive coating disposed therebetween, to form a preform/patch composite;

iii. folding the primary flap about the peripheral baseline to a closure position thereof whereat same lies in substantially stacked relation relative to the gusset panels;

folding the secondary flap about the peripheral baseline to a closure position thereof whereat same lies in substantially stacked relation against the primary flap; and providing means for securing the primary flap and the secondary flap at their respective closure positions.

2. A process according to claim 1, wherein the preform is provided with four longitudinal creases, associated one each with the division lines and coincident therewith, which divide the preform into four substantially rectangular preform portions associated one each with the bottom-forming portions and each including its associated bottom-forming portion, said preform portions including a pair of substantially congruent face preform portions associated one each with the flap-forming panels, and a pair of substantially congruent side preform portions associated one each with the gusset panels.

3. A process according to claim 2, wherein the preform is provided with a peripheral crease which is aligned coincident with the peripheral baseline and which divides said face preform portions into said flap-forming portions and into respective face wall panels, and divides said side preform portions into said gusset panels and into respective side wall panels.

4. A process according to claim 3, wherein the preform is provided with a pair of bag-opening creases for each side wall panel, said bag-opening creases being associated one each with the longitudinal creases which bracket said each side wall panel and extending, each from the intersection of its associated longitudinal crease with the peripheral crease, upwardly towards one another, so as to divide said each side wall panel into a triangular base portion, contiguous with the gusset panel of the side preform portion of which said each side wall panel forms part, and a notched portion.

5. A process according to claim 4, wherein the preform is provided with a medial crease for each side wall panel and extending lengthwise from the intersection of the bag-opening creases thereof to the preform upper end to divide the notched portion of said each side wall panel portion into a pair of polygonal panels.

6. A process according to claim 5, wherein the preform is further provided with an intermediate crease extending, in parallel relation to the peripheral crease, between the intersections of the bag-opening creases of each side wall panel to divide one of the face wall panels into a primary part spaced from the flap-forming panel of the face preform portion of which said face wall panel forms part, and a secondary part contiguous with said flap-forming panel, and to divide each of the polygonal panels contiguous with said one flap-forming panel into an upper primary part and a lower secondary part.

7. A process according to claim 6, wherein, at the open configuration, each side wall panel is folded along the medial crease thereof such that the primary part of each of the polygonal panels contiguous with said one face wall panel is stacked against the adjacent polygonal panel, with the bag-facing material thereof in contact, to form a pleat.

8. A process according to claim 7, wherein, at the open configuration, the primary part of said one face wall panel and the other face wall panel are disposed in stacked relation to one another, with the pleats interleaved threebetween.

9. A process according to claim 8, wherein, at the open configuration, said one face wall panel is folded along the intermediate crease such that the secondary part thereof is disposed in stacked relation against the primary part thereof, with the bag-facing material thereof in contact, thereby to leave exposed a portion of the other face wall panel which, in combination with the quadrilateral flap, said secondary part and the ridged flap, forms a substantially smooth surface.

10. A process according to claim 9, wherein the preform has a first adhesive layer disposed between the liner and the shell and extending about the preform lower end substantially continuously between the second slits of said one flap-forming portion.

11. A process according to claim 10, wherein the preform has a second adhesive layer disposed between the liner and the shell and extending about the preform lower end substantially continuously between the diagonal creases of the other flap-forming portion.

12. A process according to claim 11, wherein the preform has a pair of third adhesive layers disposed between the liner and the shell, extending about the preform lower end and associated one each with the gusset panels, each third adhesive layer extending substantially continuously across its associated gusset panel and beyond the division lines bracketing same.

13. A process according to claim 12, wherein, in the preform/patch composite, the peripheral edge of the patch defines an elongate first edge aligned, on the ridged flap, substantially parallel to the preform lower edge, disposed between the preform lower edge and polygonal gussets, and extending substantially between the first slits;

elongate second and third edges extending, from opposite ends of the first edge, onto and across the polygonal gussets, across the second bottom-forming portions, and onto the triangular gussets, to respective ends; and a fourth edge extending between the ends of the second and third edges.

14. A process according to claim 13, wherein the first adhesive coating seals a peripheral region of the patch to the primary and secondary flaps and to the gusset panels.

15. A process according to claim 14, wherein the first adhesive coating covers substantially all portions of the patch which overlie the primary and secondary flaps in the preform/patch composite.

16. A process according to claim 15, wherein the first adhesive coating covers portions of the patch which overlie the wall-forming part immediately adjacent the pen peripheral baseline in the preform/patch composite.

17. The bag formed by the process of claim 16.

18. The bag formed by the process of claim 1.

* * * * *